United States Patent [19]

Rentzsch et al.

[11] 3,991,683

[45] Nov. 16, 1976

[54] SAFETY DEVICE FOR PROJECTILES

[75] Inventors: Max Rentzsch, Furth; Günther Hofmann, Nurnberg, both of Germany

[73] Assignee: DIEHL, Nurnberg, Germany

[22] Filed: Jan. 30, 1973

[21] Appl. No.: 328,127

[30] Foreign Application Priority Data

Feb. 2, 1972 Germany ..... 2204823

[52] U.S. Cl. ..... 102/49.6; 89/1.812; 102/49.3

[51] Int. Cl.[2] ..... F42B 15/10

[58] Field of Search ..... 102/49.1, 49.3, 49.6, 102/49.7, 49.8, 70, 70.2; 89/1.812, 1.814

[56] References Cited

UNITED STATES PATENTS

| | | | |
|---|---|---|---|
| 2,703,960 | 3/1955 | Prentis | 102/49.7 |
| 3,343,489 | 9/1967 | Whitehouse | 102/49.6 |
| 3,714,863 | 8/1971 | Sindall | 89/1.812 |

FOREIGN PATENTS OR APPLICATIONS

| | | |
|---|---|---|
| 1,961,264 | 6/1971 | Germany |

*Primary Examiner*—Harold Tudor
*Attorney, Agent, or Firm*—Walter Becker

[57] ABSTRACT

A projectile having a chamber containing a propellant charge with an electric igniter and also having a chamber containing an explosive charge with a time delay fuse. The chambers are separated by a wall in which there is a firing pin actuated by pressure from the propellant charge when ignited to start the time delay fuse. The projectile has a safety pin locking the firing pin in ineffective position and which is withdrawable to arm the projectile. The fuse has a detonator spaced from the firing pin and a heat resistant resilient disc is interposed between the firing pin and detonator and is connected about the periphery to the wall on the side facing the detonator while a passage through the wall equalizes the pressures in the chambers.

2 Claims, 2 Drawing Figures

SAFETY DEVICE FOR PROJECTILES

The present invention relates to a safety device for projectiles in which the explosive charge is initiated or fired by the propelling charge through a delayed action fuse, while between the propelling charge and an ignition transfer member operable by the propelling charge gases, preferably a firing pin operable by the gas pressure, there is provided a safety element which prior to the introduction of the projectile into the mortar tube is manually removable and in its safety position blocks an axial movement of the firing pin.

A projectile with an electrically ignitable propelling charge has become known according to which the ignition of the explosive charge provided in the splinter head of the projectile is effected by the propelling charge through a gas-operable firing pin and a delayed action fuse released by the latter. For purposes of deactivating, i.e. preventing the firing pin from carrying out an axial movement during the transport of the projectile, there is provided a safety member in the form of a fuse safety pin, which prior to the insertion of the projectile into the mortar tube is pulled out laterally.

At the high pressure and the heat generated during the ignition of the propelling charge, there could arise the danger that also when the fuse safety pin is in its inserted position, in other words, when the firing pin is blocked, the bore for the firing pin is washed out by the hot gases and that particles be thrown against the detonator of the delayed action fuse if due to some circumstances the propelling charge of the projectile were ignited outside the mortar tube.

It is, therefore, an object of the present invention to provide a safety device which will assure that when the fuse safety pin is in its inserted position, an ignition of the delayed action fuse of the explosive charge cannot occur.

These and other objects and advantages of the invention will appear more clearly from the following specification, in connection with the accompanying drawing, in which.

The safety device according to the present invention is characterized primarily in that the detonator of the explosive charge on the side toward the firing pin is covered up by an elastic heat resistant disc of synthetic material.

This disc will assure that even when hot particles of the propelling charge pass around the firing pin blocked by the fuse safety pin and act upon the pressure piston of said firing pin, no particles can impact upon the detonator cap of the detonator for the explosive charge. Since, however, the gases which are under high pressure could, when acting upon the disc of synthetic material, apply pressure through said disc upon the detonator cap, a pressure equalizing bore is provided between a receiving chamber of the firing pin and a chamber surrounding the detonator at the head end. This bore causes the gas pressure which during the ignition of the propelling charge acts upon the disc of synthetic material to be the same on both sides so that it will not exert pressure liable to actuate the detonator cap.

Figure 1:
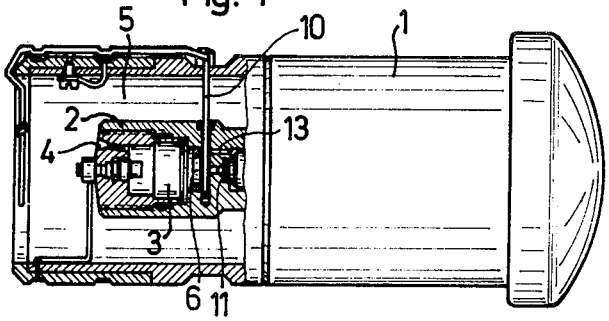
FIG. 1 illustrates a side view partially in section of a projectile equipped with a safety device according to the invention.

Referring now to the drawing in detail, FIG. 1 illustrates a projectile 1 which in its head is provided with a splinter carrier and also with an explosive charge for breaking up the splinter carrier. In the interior of the projectile 1 there is furthermore provided a combustion chamber 2 for an expelling propelling charge 3, the gases of which will after the ignition escape through bores 4 rearwardly and outwardly into an inner chamber 5 of the projectile 1. In view of the propelling charge 3, and the gas pressure thereof, a firing pin guided in a cylindrical chamber 7 is acted upon, which firing pin is axially displaceable and forms the front of the combustion chamber. A safety element in the form of a fuse safety pin 10 firmly holds the firing pin 6, said safety element being adapted to be laterally pulled out in order to arm the projectile.

Figure 2:
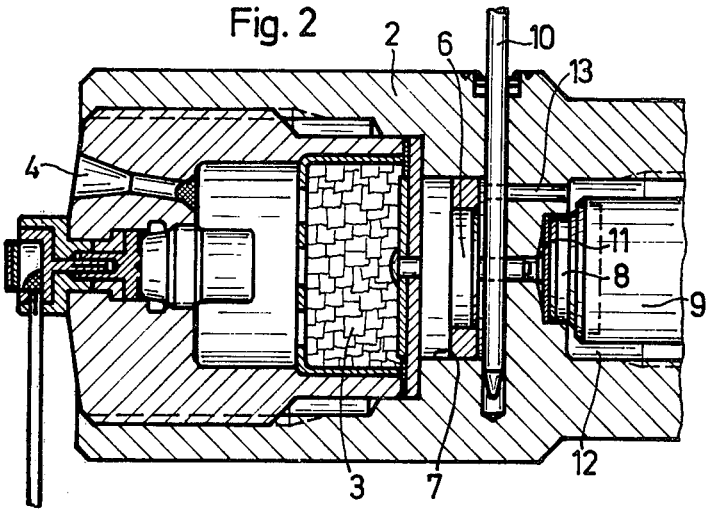
FIG. 2 shows a portion of the projectile of FIG. 1 with a safety device according to the invention, but on a larger scale than that of FIG. 1.

As will be seen from FIG. 2, the end of the firing pin 6 is spaced from a detonator cap 8 of a delayed detonator 9 through which the explosive charge of the splinter carrier can be ignited. According to the invention, between the firing pin 6 and the detonator cap 8, there is provided a disc 11 of synthetic material which covers the detonator cap 8 facing the cylinder chamber 7. This disc 11 is elastic, but is heat resistant. In order to prevent pressure from the cylinder chamber 7 at the firing pin side acting upon the disc 11 of synthetic material, which could instantaneously bend the disc 11 toward the detonator cap 8, there is provided a pressure equalizing bore 13 which is located between the cylinder chamber 7 of the firing pin 6 and a chamber 12 surrounding the detonator 8,9 at the head side thereof beyond the end covered by disc 11.

It is, of course, to be understood that the present invention is, by no means, limited to the particular showing in the drawing, but also comprises any modifications within the scope of the appended claims.

What is claimed is:

1. In a projectile, a first chamber having a propellant charge, a second chamber separated from the first chamber by a wall and having a detonator therein adjacent said wall, a firing pin extending through the wall and subject to pressure of the explosion of said propellant charge to move it to actuate said detonator so as to be detonated by said firing pin upon movement by the pressure of the explosion, a safety member blocking movement of said firing pin toward said detonator and removable to allow such movement, and a disc of heat resistant material covering the side of said detonator toward said firing pin and preventing hot gases which pass by said pin from contacting the side of said detonator facing said pin, said disc being elastic to allow impact of said firing pin to detonate said detonator.

2. In a projectile as claimed in claim 1, in which said disc is supported about its periphery by said wall and a bore passes through the wall between said chambers, so that the pressure in said two chambers is substantially equalized following an explosion of said propellant charge.

* * * * *